United States Patent [19]

Smith

[11] 4,178,693

[45] Dec. 18, 1979

[54] SPLIT IMAGE BOW SIGHT AND RANGE FINDER

[76] Inventor: Gene D. Smith, 4113 Edwinstowe, Colorado Springs, Colo. 80907

[21] Appl. No.: 955,592

[22] Filed: Oct. 30, 1978

[51] Int. Cl.[2] ..... F41G 1/46

[52] U.S. Cl. ..... 33/265

[58] Field of Search ..... 33/265; 124/87; 356/17, 356/21, 22

[56] References Cited

U.S. PATENT DOCUMENTS

| | | | |
|---|---|---|---|
| 2,788,701 | 4/1957 | Browning | 33/265 |
| 3,163,697 | 12/1964 | White | 33/265 |
| 3,487,548 | 1/1970 | Frydenlund | 33/265 |
| 3,524,440 | 8/1970 | Hill | 33/265 |
| 3,861,051 | 1/1975 | Killian | 33/265 |

*Primary Examiner*—Richard R. Stearns
*Attorney, Agent, or Firm*—W. Britton Moore

[57] ABSTRACT

An archery bow sight and range finder including a pair of vertically spaced and laterally extending mirrors slidably mounted on a bow attached bracket and finger trigger actuable by the archer when grasping and aiming the bow. A center bead is associated with the lowermost mirror and the angle of the upper mirror is changed by trigger action to vary the elevation angle of the bow, with split image viewing being employed, combined with trigger action, to locate the exact range of target, one half of the target being viewed directly and the other half being seen through the mirrors. Lateral point of aim is determined by the lower mirror bead being positioned in the center of the combined split image.

10 Claims, 16 Drawing Figures

SPLIT IMAGE BOW SIGHT AND RANGE FINDER

This invention relates to an archery bow sight and range finder embodying a pair of spaced mirrors slidably mounted on a bow attached bracket and finger trigger actuable by the archer to determine angle of bow elevation and the exact range of a target, with one half of the target being viewed directly and the other half being seen through the mirrors.

Various archery bow sighting devices have heretofore been proposed, such as, those represented, for example, in U.S. Pat. Nos. to Frederickson 2,542,501 and 2,642,661, Ambraziatis 3,320,670, and Heffer 3,715,807. Generally such devices are usually concerned with enabling the archer to observe arrow draw, but no provision is made for finger trigger actuable control to effect split image bow sighting and range finding which effectively enables the archer to readily determine the angle of bow elevation and the exact range of a target by viewing one half of the target directly and the other half through the mirrors.

The principal object of the present invention is to provide a split image optical bow sight and range finder wherein a pair of spaced mirrors are slidably arranged on a bow mounted and trigger actuable bracket which enables the archer to vary the angle of elevation of the bow by vertically adjusting the mirrors to effect split image viewing therethrough, with one half of the target viewable directly and the other half being viewed through the mirrors to enable determination of the exact range of target.

Another object is the provision of a split image optical bow sight and range finder including a forwardly and upwardly projecting bracket removably attachable to a bow and having a pair of vertically spaced and angularly disposed mirrors carried by a vertical slide bar thereof and extending laterally relative to the arrow rest, with the slide bar being slidably and vertically actuable relative to a range scale on the bracket by a finger controlled trigger pivoted thereto whereby, when aimed at a target, one half thereof is viewed directly and the other half through the mirrors to provide correct sighting and range finding.

Still another object is to provide a bracket attached perpendicular to the plane of the bow and having an upright channel member at the outer end thereof with a slide bar arranged slidably thereon, and having upper and lower laterally and angularly projecting mirrors at opposing ends of the slide bar, with the upper mirror being angularly tilted during vertical movement of the slide bar under trigger control by a lever engageable with a cam surface associated with the channel member.

A further object is the provision of a bow sight and range finder wherein the angular relationship of the two mirrors determines the angle of elevation of the bow when sighting.

Still a further object is to provide a cam surface on the channel member of the bow mounted bracket of a shape or configuration which is a small scale duplicate of the trajectory path of an arrow of specific weight when propelled by a bow of specific pull strength, and whereby either a cam may be selectively installed thereon to accommodate one of various specifications of bows and arrows, or an adjustable cam may be utilized to duplicate any trajectory path normally encountered.

These and other objects and advantages will be apparent as the specification is considered with the accompanying drawings, wherein FIG. 1 is a side elevation of a right handed archer holding and operating a right handed bow with the combined split image optical bow sight and range finder mounted thereon in sighting position;

Figure 4:
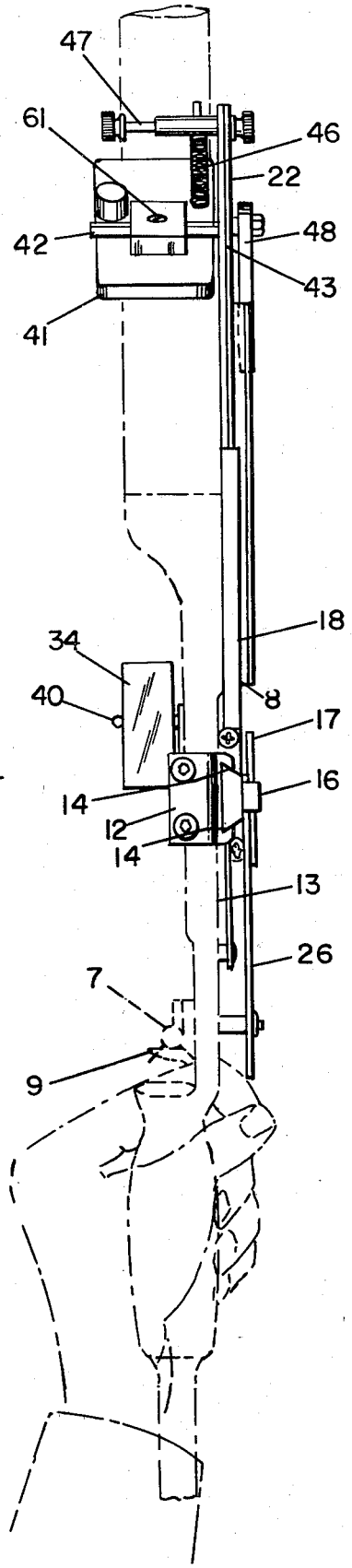
FIG. 4 is a rear elevation showing a right handed bow gripped in the archer's left hand.
Figure 5:
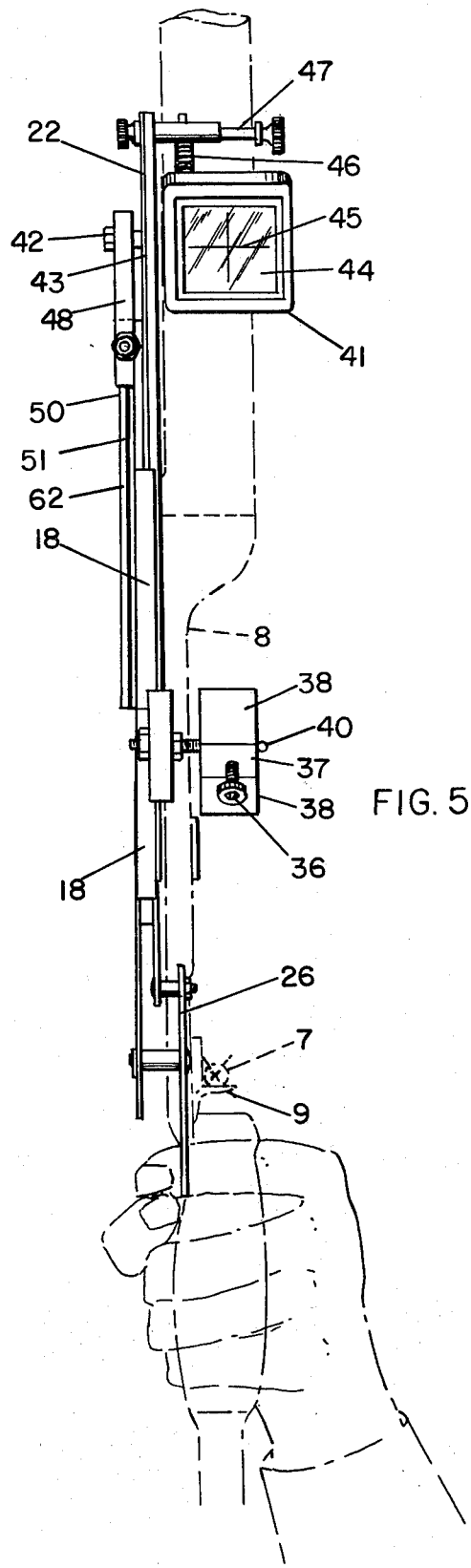
FIG. 5 is a front elevation of the bow shown in FIG. 4.
Figure 6:
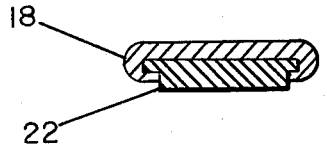
FIG. 6 is a section through the channel and slidable bar of the mirror mounting bracket.

Referring more particularly to the drawings, wherein similar reference characters designate like parts throughout the several views, numeral 1 generally indicates a conventional right handed archery bow including a midsection 2 having a curved hand grip 3 interposed between and detachably connected to upper and lower bow sections 4 and 5. A bow string 6 is attached to the free ends of sections 4 and 5, in the usual manner, for projection of an arrow 7 when positioned on the usual arrow rest 9, arranged in an inset 8 on the left side of midsection 2 above hand grip 3, viewing FIG. 4, as the archer grasps hand grip 3 in the left hand and draws bow string 5 rearwardly with the right hand. While the bow sight and range finder hereof, and hereinafter to be described, is adapted for use with either right or left handed bows, only its use with the former will be herein specifically described. It will, of course, be understood that when used with a left handed bow, wherein the bow is gripped in the right hand and the bow string pulled with the left hand, reversal of the mirror supporting bracket, channel member and slide bar, associated mirrors and trigger elements will be required, as the inset and rest will be arranged on the right side of the bow, which, thus, requires mounting of the mirror bracket on the opposite or left side of the bow so that the mirrors extend to the right and are disposed above the arrow rest.

A bow sight and range finder supporting bracket 10 is flat, elongated and formed with tapered edges 11 for interfitting with and slidable longitudinal adjustment in a flat sleeve member 12, suitably affixed to a side wall 13 of bow midsection 2, and having upper and lower tapered flanges 14. The bracket 10 and sleeve 12 may be formed of any suitable metal or plastic, but when of the former, a plurality of threaded apertures 15 may be provided at the inner end to reduce the weight thereof, in addition to receiving a threaded bolt 16 with a pin 17 extending therethrough so that, when the bolt is positioned in an aperture aligned with the sleeve 12 and tightened, the bracket may be fixedly secured in the sleeve.

Suitably affixed to an outer end of bracket 10, as at 19, and extending upwardly therefrom at right angles thereto is a bow sight and range finder flat supporting channel member 18 having inturned side edges 20 to provide a track or slide 21 therebetween. Arranged in track 21 for vertical movement therein is a flat elongated slide bar 22 which is flatly received in the track and is retained therein by the inturned edges 20 thereof. The slide bar 22 is vertically moved in track 21 by a link 23 pivotally attached, as at 25, to the lower end 24 of the slide bar, and to the upper end 27 of a generally L-shaped trigger 26, in turn pivoted intermediate its ends, as at 28, to a downwardly depending trigger mounting bracket 29, suitably affixed, as at 30, at its upper end to bracket 10. As the lower end of trigger 26 is formed with a finger receiving recess 31, downward pivotal movement thereof will pull the slide bar 22 downwardly, against the tension of a coil spring or the like 56 extending between slide bar 22 and the lower end of a cam plate 50 presently to be described, in an obvious manner and for a purpose hereinafter to be described.

Figure 1:
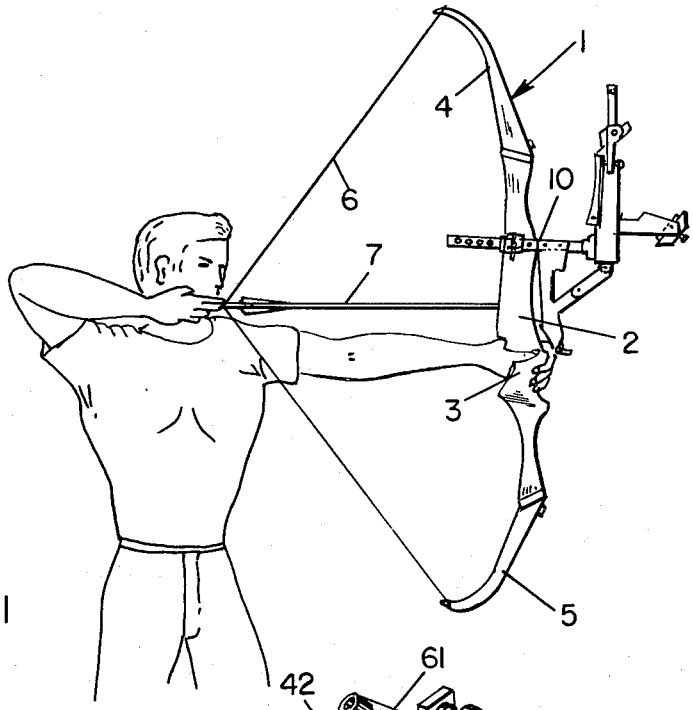
Figure 2:
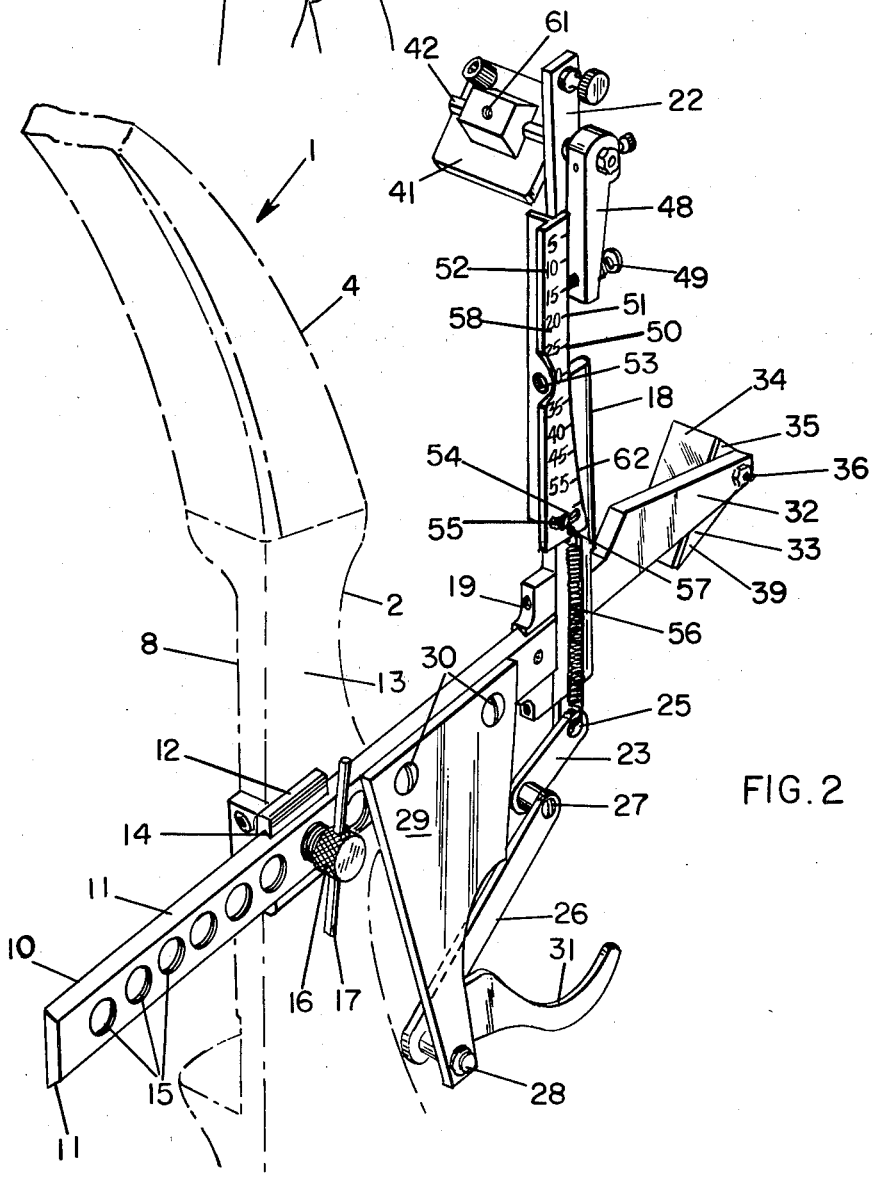
FIG. 2 is a perspective view of a portion of a right handed bow with the bracket and mirror mounting portions and finger actuable trigger arranged thereon.
Figure 3:
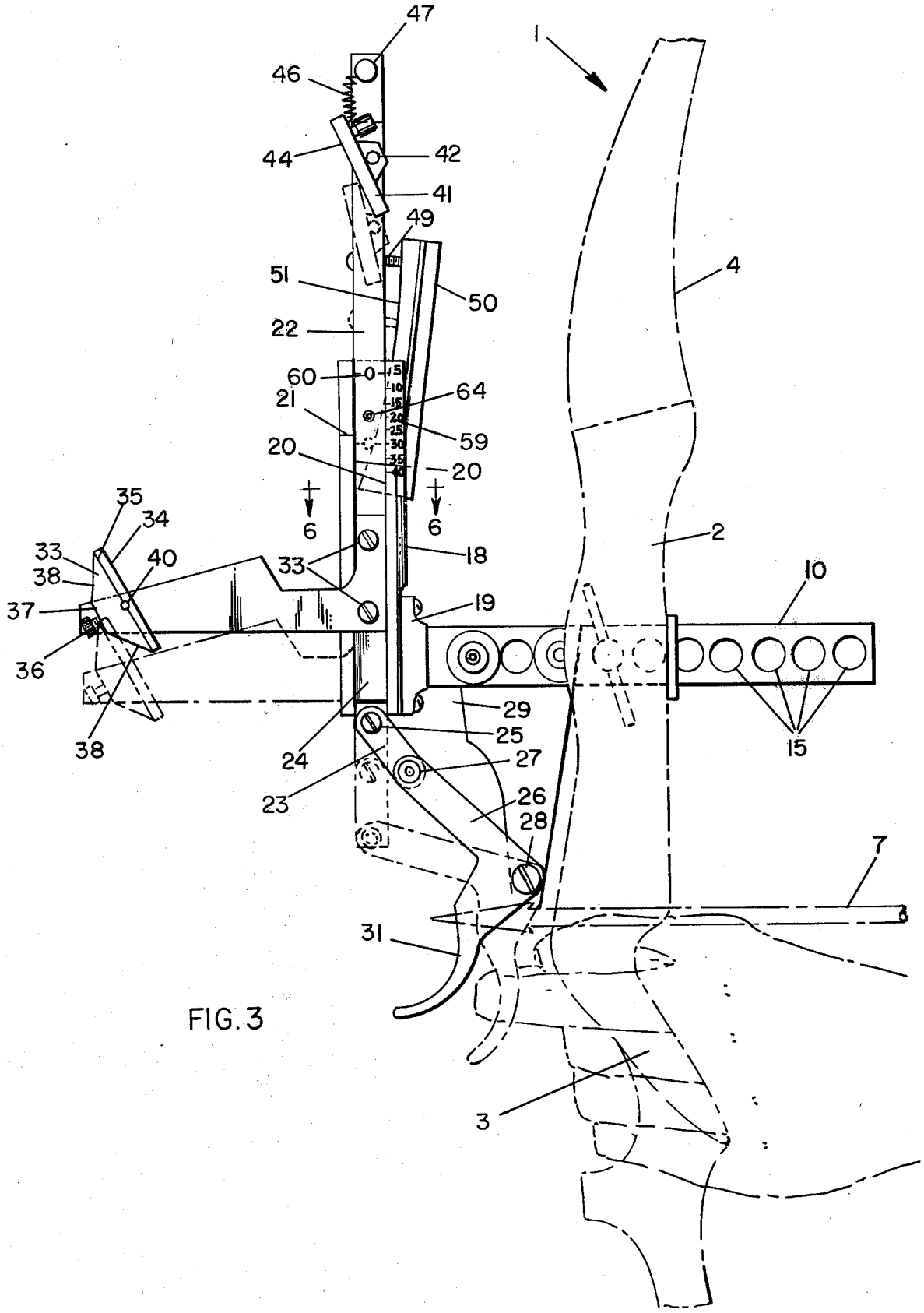
FIG. 3 is a side elevation, from the left side of a right handed bow, showing how the sight and range finder bracket and associated mirrors is mounted thereon, and the trigger is actuable by a finger on the archer's left hand.

Projecting forwardly from and suitably attached, as at 33, to the slide bar 22 above its lower end 24 is a flat arm 32 having a mirror casing 33, with a generally rectangular mirror 34 supported on the flat upper wall surface 35 thereof, angularly supported on the outer end thereof by a screw or the like 36 projecting laterally therefrom. The mirror casing 33 is trapezoidal with a reduced flat bottom wall 37 spaced from and parallel to top wall 35, oppositely, inwardly and downwardly angled end walls 38, and straight side walls 39. Casing 33 and the mirror 34 thereof extend at an acute angle relative to arm 32, viewing FIGS. 1 and 3, although this angle may be adjusted through the medium of screw 36. A colored sighting bead or the like 40 may be provided at a side edge of the mirror 34 to assist in sighting.

A generally flat rectangular mirror frame 41 is pivotally mounted adjacent the upper end of slide bar 22 by a rod 42 fulcrummed therein, as at 43, and has a flat rectangular mirror 44 on its under side. Mirror 44 is formed with the intersecting cross hairs 45 and extends spacedly above and at generally the same acute angle as lower mirror 34. Attached at its lower end to the rear of mirror frame 41 at the upper end thereof is a spring 46 having its upper end connected to the inner end of a pin 47 projecting laterally from the upper end of slide bar 22, which spring serves to return the mirror to its normal position as the latter is adjustably rotated in a clockwise direction, viewing FIG. 3, as presently to be described.

The inner end of rod 42 is connected to the upper end of a downwardly depending arm 48 having a screw 49 projecting through the lower end thereof which engages a flat curved front edge 51 of a right angularly extending side plate 52 of an elongated T-shaped cam plate 50. The latter extends vertically and at a slight angle with respect to channel member 18, and is suitably pivotally bolted to the rear face to the channel member by a bolt 53 extending through cam plate 52. An arcuate slot 54 is formed in the lower end of cam side plate 52 and receives a bolt 55 therethrough to adjustably connect plate 52 for relative angular adjustment to channel member 18, should such adjustment be required. Suitable spring means, such as coil spring 56, connects the lower end of cam plate 50 to the lower end of slide bar 22, as at 57, so that actuation of trigger 26 will pull the slide bar 22 downwardly in channel member 18 against spring pressure to adjust the angular position of upper mirror 44, during sighting and range finding hereinafter to be described.

Figure 7:
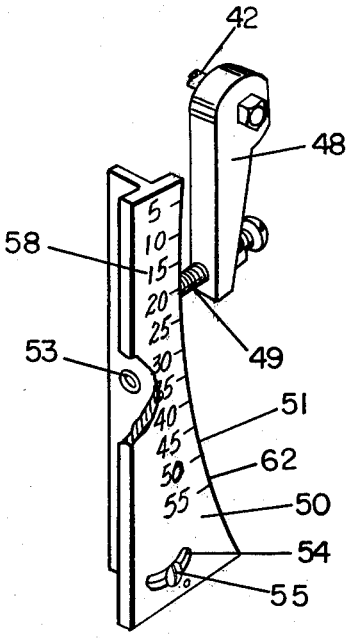
FIG. 7 is a perspective view of a cam surface on the bracket channel member representing the trajectory assumed in flight of a heavy arrow.

As best shown in FIG. 7, a vertical range scale 58, graduated from 5 to 55, is provided on the rear face of side plate 52 of cam plate 50 attached to the rear face of channel member 18. The rear face of the channel member 18 is correspondingly provided with a vertical range scale 59, (FIG. 3) graduated from 5 to 55. An —O— scale marker 60 on the front face of slide bar 22 is alignable with the numerals 5 on scales 58 and 59, in the normal inactive position of the slide bar. The graduated range marks on the scale 59 on channel member 18 convert the bow sight into a range finder and function to calibrate the cam plate 50 and upper and lower mirrors 44 and 34, when the sight is installed on the bow. To compensate for any errors in installing the sight bracket 10, cam plate 50 may be adjusted by loosening bolt 55 in arcuate slot 54 and angularly moving the cam plate. The mirrors may also be adjusted by set screws 61 in the rear of the frames thereof.

Figure 8:
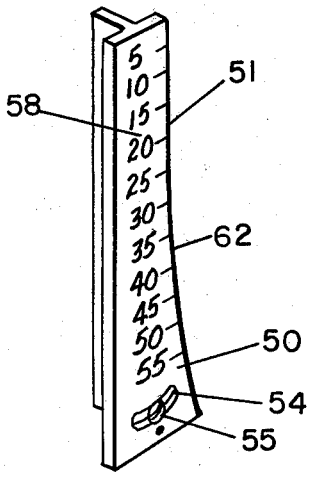
FIG. 8 is a perspective view of a cam surface on the bracket channel member representing the trajectory assumed in flight of a light arrow.

The front edge 51 of side plate 52 is flat, but is curved downwardly and forwardly along its forward edge 62 (FIG. 7), and the plate curvature represents a small scale duplicate of the trajectory path of an arrow of specific weight propelled by a bow of specific pull strength. To solve the problem of various pull strengths in bows, and various weights of arrows, a number of cam plates with variously curved front edges may be employed and selectively and individually installed on channel member 18 to accommodate various specifications of bows and arrows. For example, in FIG. 8, the somewhat shallow plate edge curvature required for a light arrow is shown, whereas, in FIG. 7, the more pronounced curvature depicts the cam plate and edge curvature required for a heavy arrow. In lieu of the requirement for making such a preliminary determination and selection, an adjustable cam plate, not shown, may be so mounted and adjusted to enable the archer to duplicate any trajectory path normally encountered. Cam plates having variously curved side forward edges may be employed and selectively and individually installed on the channel member 18 to accommodate various specifications of bows and arrows. For example, in FIG. 8, the somewhat shallow plate edge curvature required for a light arrow is shown, whereas, in FIG. 7, the more pronounced curvature depicts the cam plate required for a heavy arrow.

The curvature of the cam is determined by mathematics of trajectory of an arrow propelled by "X" pounds of force. A bow of given pull strength will only deliver the rated pounds of thrust, if the string is pulled to the rating point, designated "X". If, however, the archer has a shorter arm, making him incapable of pulling to "X", the pounds of thrust imparted to the arrow will be less. Therefore, the archer must determine the force he is capable of developing on a given bow, using a weight scale, and, by using this information in conjunction with the weights of the arrows being used, a series of cam plates may be designed by trajectory mathematics. It is to be understood that each cam plate is designed for a specific archer, pulling a bow string a specific distance on a bow of specific pull strength, and firing an arrow of specific weight.

From the foregoing, it will be apparent that the angle of the mirrors 34 and 44 acting together determines the angle of elevation of the bow when sighting. Once the proper angle of lower mirror 34 is established, this mirror is locked in place and does not, thereafter, change angle. Thus, to change the sighting elevation angle of the bow, the angle of upper mirror 44 will be changed by the screw 49 in the lower end of arm 48 riding over the surface of cam plate 50, as trigger 26 is depressed.

To effect calibration, after installation of the bow sight, with the proper cam plate 50 for that bow and weight arrow attached, the mirrors 34 and 44 and cam plate 50 must be adjusted to match the flight path of the arrow. This is effected by the trial and error method of sighting in, similar to that employed when sighting in a rifle, following the installation of a telescopic sight. Keeping in mind that cam plate 50 represents the flight path, it is necessary to adjust the mirrors 34 and 44 and the cam plate so that the point of aim corresponds with the path of the arrow. At rest or inactive position, trigger 26 is at 5 yard range.

A skilled archer may make initial adjustments of the mirrors 34 and 44 by test pulling the bow when aiming at a target 5 yards distant. The adjustment of cam plate 50 is effected after test firing proves accuracy in point of aim of the mirrors at this range. With the initial settings of the mirrors made, as described, test firings must be made to determine if the flight of the arrow is in harmony with the point of aim.

Figure 9:
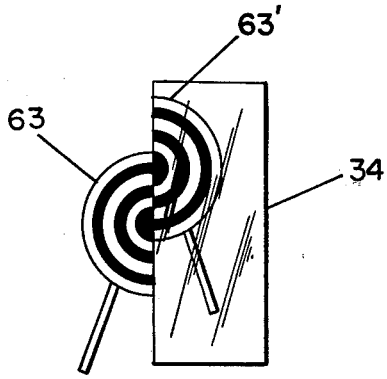
FIG. 9 is a view of a target and how a right handed archer initially views the left half of the target line of sight, and the right half of the target through the lower mirror.
Figure 10:
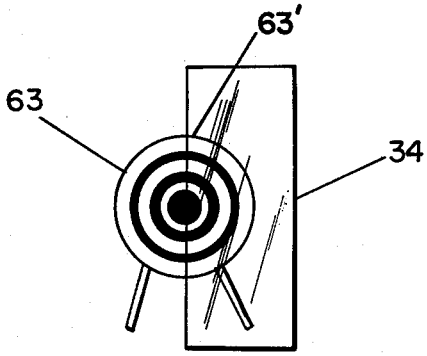
FIG. 10 is a view of the target of FIG. 8 after aiming of the arrow has been adjusted until the direct and reflected views of the target are aligned.

Referring to FIG. 9, a right handed archer views the right half 63' of a target 63 through lower mirror 34 and the left half of the target line of sight. If this view is as depicted in FIG. 9, he would depress trigger 26 and adjust aiming of the arrow until the view is as in FIG. 10, wherein the right and left halves of the target are aligned with reference to the mirror cross hairs, at which time the archer releases the arrow. If the arrow pierces the target low, but on center, it indicates that the upper mirror 44 should be adjusted clockwise, or the lower mirror 34 counterclockwise, to bring the point of aim up slightly. Once it is established that the arrow hits the target consistently at the 5 yard range, no further adjustment to the mirrors 34–44 is necessary. Left handed archers will, of course, view the left half of the target through lower mirror 34 and the right half of the target line of sight, and adjust accordingly.

If the arrows, in test firings, hit consistently center right or center left of the target, it indicates installation error of the mounting bracket 10, which may require shimming thereof to bring the bracket into parallelism with the movement of the bow string.

After the point of aim has been established at the 5 yard range, it is necessary to harmonize cam plate 50 with upper mirror 44. The cam follower screw 49 on arm 48, in riding over the cam plate face, as the trigger 26 is depressed, tilts mirror 44 to raise the point of aim, as the range is increased. Since the pivot screw 53 for the cam plate is located at the 5 yard range, the setting established by mirror adjustment, during test firings will remain constant.

Cam plate 50 is arbitrarily set at the median point of arcuate slot 54 and a test firing made at a target 30 yards distant. Should the arrow hit low on the target, it indicates that cam plate 50 must be rotated toward cam follower screw 49 to raise the point of aim. When the arrow hits consistently at the 30 yard range, the target is moved to maximum range. If there is error at maximum range, cam plate 50 may be adjusted further to split error between mid and maximum range firings.

Figure 11:
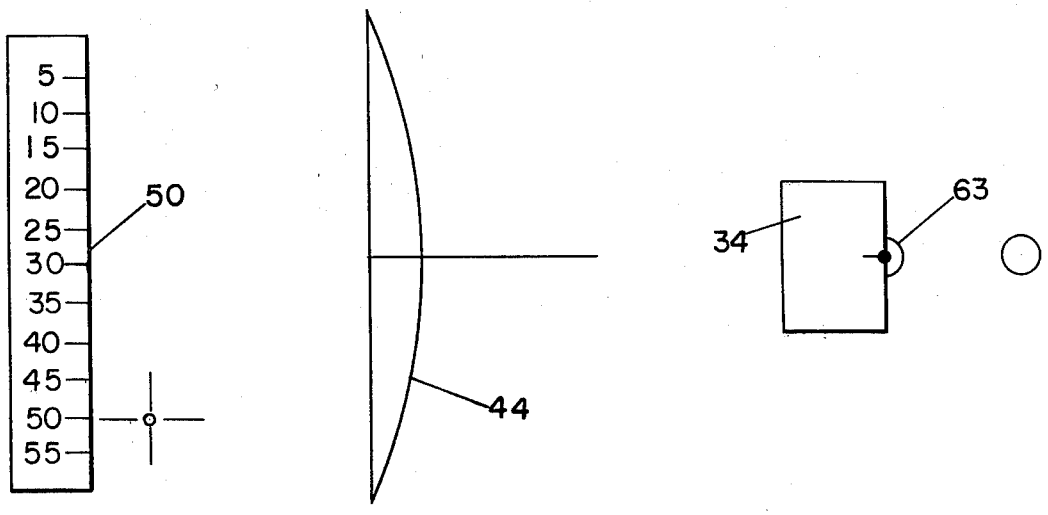
FIG. 11 is a schematic view during sighting of a target.
Figure 12:
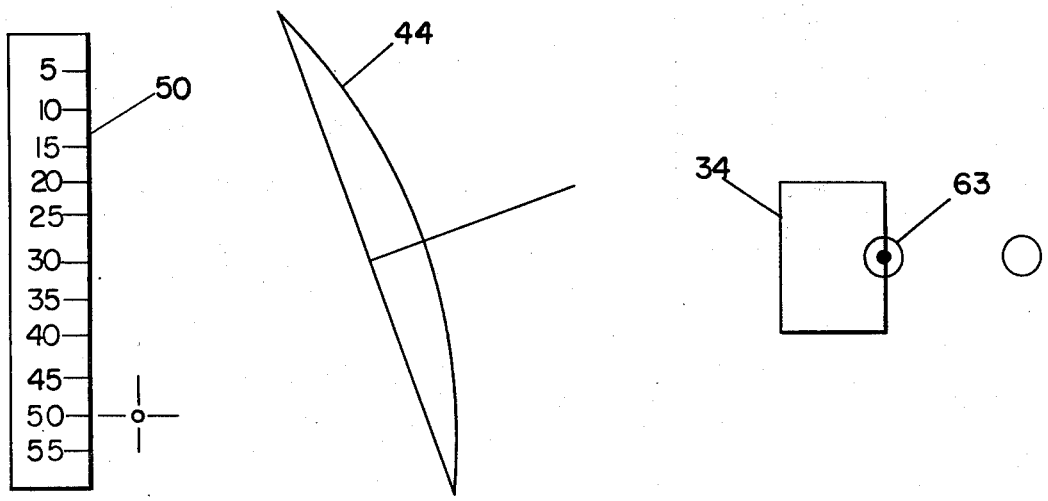
FIG. 12 is a schematic view during sighting of a target, when elevation of draw is required to obtain a proper sight picture.

From the foregoing, the functioning of the sight and range finder should be apparent. The angle of upper mirror 44 is changed by cam plate 50 when trigger 26 moves the cam follower arm 48 and screw 49 over the surface of the cam plate. As this angle changes, the archer must adjust elevation of draw to get proper sight picture, as will be evident from FIGS. 10 and 11.

For target practice where the range is known, it may be desirable to set the range on the bow sight, rather than activate trigger 26 each time a firing is made, in which event, the sight may be locked in position by turning a set screw 64 (FIG. 3) extending through slide bar 22 into channel member 18. On the other hand, when firing at unknown ranges, the archer merely depresses trigger 26 until the proper sight picture is obtained, with a read out of the range being indicated on the range scale.

Figure 13:
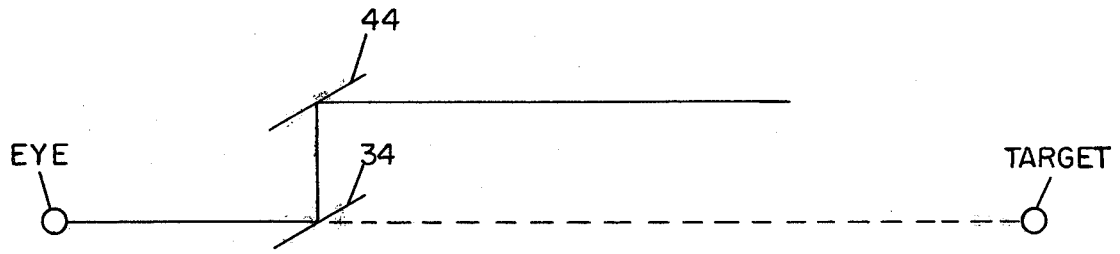
FIGS. 13–16 are schematic views representing varying trigger and mirror adjustments to obtain the proper sight picture depicted in FIG. 16.
Figure 14:
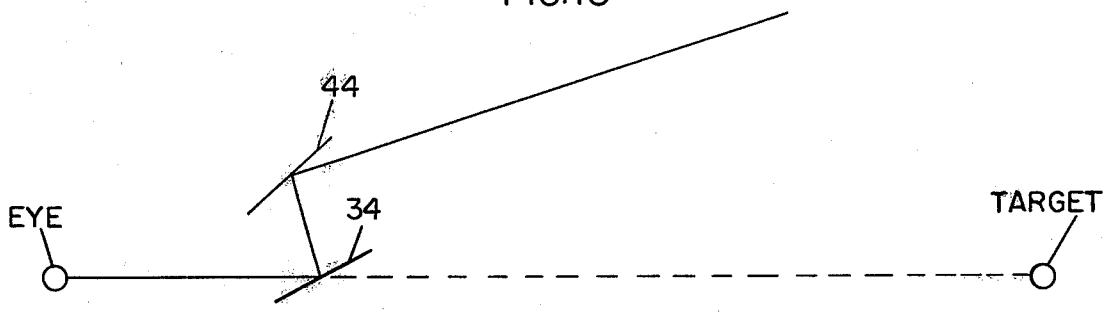
Figure 15:
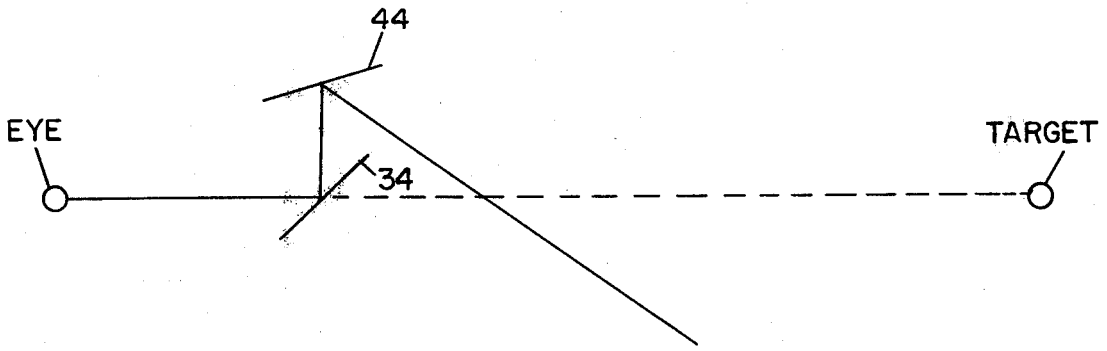
Figure 16:
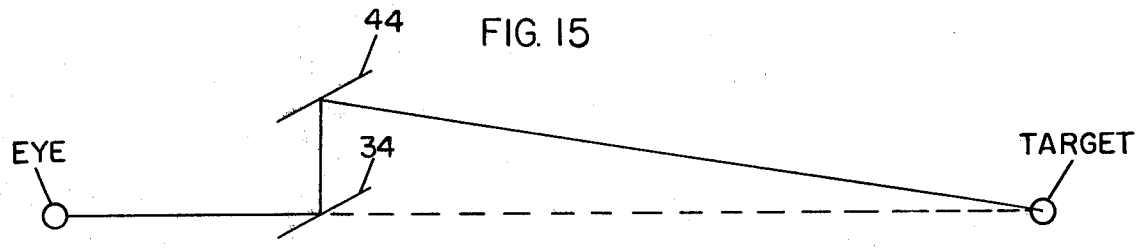

The relationship of the two mirrors must be kept in mind for a clear understanding hereof. Split image ranging must be understood. Visualize the mirrors in various juxtaposition, with lower mirror 34 fixed, as shown schematically in FIGS. 13 to 16, with FIG. 16 depicting the proper sight picture. To obtain such a proper sight, the angle of the upper mirror 44 and the angle of the bow must be adjusted. In FIG. 13, assuming the angle of the lower mirror is correct, the trigger 26 must be pulled to change the angle of the upper mirror 44 until it conforms to FIG. 16. The same applies to FIGS. 14 and 15, wherein the angle of the upper mirror must be changed by trigger action, either by depressing or releasing the latter. The relationship of the mirrors, cam plate, and trigger action may be readily observed, by anyone not having a knowledge of archery, by sighting through the sight and range finder at various ranges which will demonstrate the various angles at which the bow must be held to obtain the proper sight picture thereat.

While a preferred embodiment of split image bow sight and range finder has been shown and described, it is to be understood that various changes and improvements may be made therein without departing from the scope and spirit of the appended claims.

What I claim is:

1. A split image bow sight and range finder assembly comprising bracket means for mounting said sight on a bow relative to an arrow horizontally positioned against said bow, slidable means on said bracket means having trigger means pivotally associated therewith for actuating said slidable means, vertically spaced mirror means mounted on said slidable means and angularly oriented to reflect an image of a target to the archer, one of said mirror means being pivotally mounted on said slidable means, cam means associated with said bracket means and slidable means whereby actuation of said trigger means moves said slidable means to adjust said pivotal mirror means with reference to the other of said mirror means and reflects an image of a target in said latter mirror means, and range scale means on said bracket means and cam means for determining target range during mirror means trigger means controlled adjustment to enable determination of the angle of bow elevation before release of the arrow.

2. In a split image bow sight and range finder assembly according to claim 1, wherein said mirror means includes a pair of spaced angularly oriented mirrors.

3. In a split image bow sight and range finder assembly according to claim 2, wherein said bracket means projects forwardly from said bow and includes an upright member on the outer end thereof, with said spaced mirrors and trigger means being associated with said upright member.

4. In a split image bow sight and range finder assembly according to claim 3, wherein said slidable means includes slide bar means slidably arranged on said upright member, the lowermost of said mirrors being attached to a lower end of said slide bar means and the uppermost of said mirrors being pivotally mounted on the upper end thereof.

5. In a split image bow sight and range finder assembly according to claim 4, wherein said upright member is flatly elongated and formed with a track means thereon, and said slide bar means is flatly elongated and slidably arranged for vertical movement in said track means, and said trigger means is pivotally connected to the lower end of said upright member.

6. In a split image bow sight and range finder assembly according to claim 5, wherein said cam means is flatly elongated with a cam surface thereon and is attached to and associated with said flat upright member, said upper mirror being pivotally spring mounted on the upper end of said upright member and having arm means depending therefrom, cam follower means on said arm means engageable with said cam surface during slidable movement of said slide bar means and mirrors whereby said upper mirror is angularly adjusted relative to said lower mirror to reflect an image of a target in said lower mirror.

7. In a split image bow sight and range finder assembly according to claim 6, wherein said range scale means is graduated in yards and includes scales longitudinally disposed on said upright member and said cam means.

8. In a split image bow sight and range finder assembly according to claim 6, wherein depending bracket means on said sight mounting bracket means pivotally supports said trigger means, and an end of said trigger means is pivotally connected to the lower end of said slide bar means.

9. In a split image bow sight and range finder assembly according to claim 6, wherein said lowermost mirror is fixedly supported on bracket arm means connected to and projecting forward from the lower end of said slide bar means and projects laterally and angularly therefrom, and the upper mirror is pivotally connected to the upper end of said slide bar means and projects laterally and angularly therefrom, and said mirrors are oriented.

10. In a split image bow sight and range finder assembly according to claim 9, wherein said cam means is generally T-shaped with an elongated flat cam surface thereon, and said cam follower means includes a pin engageable with said flat cam surface.

* * * * *